US011920792B1

(12) United States Patent
Boardman

(10) Patent No.: US 11,920,792 B1
(45) Date of Patent: Mar. 5, 2024

(54) COOLING TURBINE ENGINE FUEL-AIR MIXER WITH STEAM

(71) Applicant: Raytheon Technologies Corporation, Farmington, CT (US)

(72) Inventor: Gregory Boardman, Owens Cross Roads, AL (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 18/120,818

(22) Filed: Mar. 13, 2023

(51) Int. Cl.

| | |
|---|---|
| ***F23R 3/28*** | (2006.01) |
| ***F23D 14/62*** | (2006.01) |
| ***F23D 14/64*** | (2006.01) |
| ***F23L 7/00*** | (2006.01) |
| ***F23R 3/14*** | (2006.01) |

(52) U.S. Cl.
CPC ..... *F23R 3/283* (2013.01); *F23D 14/62* (2013.01); *F23D 14/64* (2013.01); *F23L 7/005* (2013.01); *F23R 3/14* (2013.01); *F23R 3/286* (2013.01)

(58) Field of Classification Search
CPC ..... F23D 14/48; F23D 14/58; F23D 14/583; F23D 14/62; F23D 14/64; F23D 2206/10; F23L 7/005; F23R 3/14; F23R 3/283; F23R 3/286
See application file for complete search history.

(56) References Cited

U.S. PATENT DOCUMENTS

| | | | | |
|---|---|---|---|---|
| 4,955,191 | A | 9/1990 | Okamoto | |
| 5,054,279 | A | 10/1991 | Hines | |
| 5,423,173 | A * | 6/1995 | Lemon | F23L 7/00 60/776 |
| 7,536,862 | B2 | 5/2009 | Held | |
| 2007/0044477 | A1* | 3/2007 | Held | F23R 3/36 60/776 |
| 2013/0074504 | A1* | 3/2013 | Baruah | F23N 5/003 60/742 |
| 2016/0245522 | A1* | 8/2016 | Dai | F23R 3/343 |
| 2017/0159937 | A1* | 6/2017 | Kobayashi | F23R 3/283 |
| 2019/0264913 | A1* | 8/2019 | Johansson | F23D 14/78 |
| 2022/0397274 | A1* | 12/2022 | Itoh | F23R 3/283 |
| 2023/0104395 | A1* | 4/2023 | Naik | F23R 3/28 60/737 |

* cited by examiner

*Primary Examiner* — Scott J Walthour
(74) *Attorney, Agent, or Firm* — Getz Balich LLC

(57) ABSTRACT

An apparatus is provided for a turbine engine. This apparatus includes a fuel-air mixer, and the fuel-air mixer includes an inner passage, a sidewall, a steam passage, a fuel nozzle and an air swirler. The inner passage extends axially along an axis within the fuel-air mixer. The sidewall extends circumferentially around and axially along the inner passage. The steam passage is embedded within the sidewall and extends along the inner passage. The fuel nozzle is configured to direct fuel into the inner passage. The air swirler is configured to direct swirled air into the inner passage for mixing with the fuel.

19 Claims, 8 Drawing Sheets

COOLING TURBINE ENGINE FUEL-AIR MIXER WITH STEAM

BACKGROUND OF THE DISCLOSURE

1. Technical Field

This disclosure relates generally to a turbine engine and, more particularly, to utilizing steam during operation of the turbine engine.

2. Background Information

As government emissions standards tighten, interest in alternative fuels for gas turbine engines continues to grow. There is interest, for example, in fueling a gas turbine engine with hydrogen ($H_2$) fuel rather than a traditional hydrocarbon fuel such as kerosine to reduce greenhouse emissions. Combustion products produced by combusting hydrogen ($H_2$) fuel include water vapor. Various systems and methods are known in the art for recovering the water vapor. Various system and methods are also known in the art for producing and utilizing steam from the recovered water vapor. While these known systems and methods have various advantages, there is still room in the art for improvement.

SUMMARY OF THE DISCLOSURE

According to an aspect of the present disclosure, an apparatus is provided for a turbine engine. This apparatus includes a fuel-air mixer, and the fuel-air mixer includes an inner passage, a sidewall, a steam passage, a fuel nozzle and an air swirler. The inner passage extends axially along an axis within the fuel-air mixer. The sidewall extends circumferentially around and axially along the inner passage. The steam passage is embedded within the sidewall and extends along the inner passage. The fuel nozzle is configured to direct fuel into the inner passage. The air swirler is configured to direct swirled air into the inner passage for mixing with the fuel.

According to another aspect of the present disclosure, another apparatus is provided for a turbine engine. This apparatus includes a tubular body, a fuel nozzle and an air swirler. The tubular body extends circumferentially around an axis. The tubular body extends axially along the axis to a downstream body end. The tubular body extends radially between an inner side and an outer side. The inner side forms an outer peripheral boundary of an inner passage within the tubular body. The inner passage extends axially within the tubular body to an outlet orifice at the downstream body end. A steam passage is embedded within the tubular body between the inner side and the outer side. The steam passage is configured to flow steam within the tubular body to cool the tubular body along the inner passage. The fuel nozzle is configured to direct fuel into the inner passage. The air swirler is configured to direct swirled air into the inner passage for mixing with the fuel within the inner passage. The air swirler is integrated with the tubular body.

According to still another aspect of the present disclosure, an operating method is provided for a turbine engine. This method includes: injecting fuel into an inner passage of a fuel-air mixer; directing swirled air into the inner passage to mix with the fuel within the inner passage; and cooling a sidewall forming and circumscribing the inner passage. The cooling includes flowing steam through a steam passage embedded radially within the sidewall.

The method may also include: igniting a mixture of the fuel and the swirled air within the inner passage to form combustion products; and directing quench air through apertures in the sidewall to quench the combustion products within the inner passage.

The fuel nozzle may be integrated with the tubular body.

The steam passage may extend: circumferentially about the inner passage within the sidewall; and/or axially along the inner passage within the sidewall.

The fuel-air mixer may extend axially along the axis to a mixer end. The fuel-air mixer may include a plurality of steam outlets arranged at the mixer end in an array about the axis. The steam outlets may be fluidly coupled with and downstream of the steam passage.

A first of the steam outlets may be configured to exhaust steam received from the steam passage in a radial inward direction towards the axis.

A first of the steam outlets may be configured to exhaust steam received from the steam passage in an axial direction along the axis.

A first of the steam outlets may be configured to exhaust steam received from the steam passage into the inner passage.

A first of the steam outlets may be configured to exhaust steam received from the steam passage out of the fuel-air mixer.

The fuel-air mixer may extend axially along the axis to a mixer end. The inner passage may radially taper towards the axis as the inner passage extends axially along the axis away from the air swirler and towards the mixer end.

The fuel-air mixer may extend axially along the axis to a mixer end. The inner passage may radially expand away the axis as the inner passage extends axially along the axis away from the air swirler and towards the mixer end.

The air swirler may be configured as a radial air swirler.

The air swirler may be configured as an axial air swirler.

The fuel-air mixer may extend axially along the axis between an upstream mixer end and a downstream mixer end. The air swirler may be arranged at the upstream mixer end.

The fuel-air mixer may extend axially along the axis between an upstream mixer end and a downstream mixer end. The air swirler may be arranged axially between the fuel nozzle and the downstream mixer end.

The fuel-air mixer may extend axially along the axis between an upstream mixer end and a downstream mixer end. The fuel nozzle may be arranged axially between the air swirler and the downstream mixer end.

The fuel nozzle may include a plurality of fuel outlets arranged in an array about the axis. A first of the fuel outlets may be configured to inject the fuel in a radial inward direction into the inner passage towards the axis.

The fuel nozzle may include a plurality of fuel outlets arranged in an array about the axis. A first of the fuel outlets may be configured to inject the fuel in an axial direction into the inner passage along the axis.

The fuel-air mixer may also include a plurality of quench apertures arranged in an array about the axis. Each of the quench apertures may extend radially through the sidewall to the inner passage. The quench apertures may be arranged axially between the fuel nozzle and a downstream end of the fuel-air mixer.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
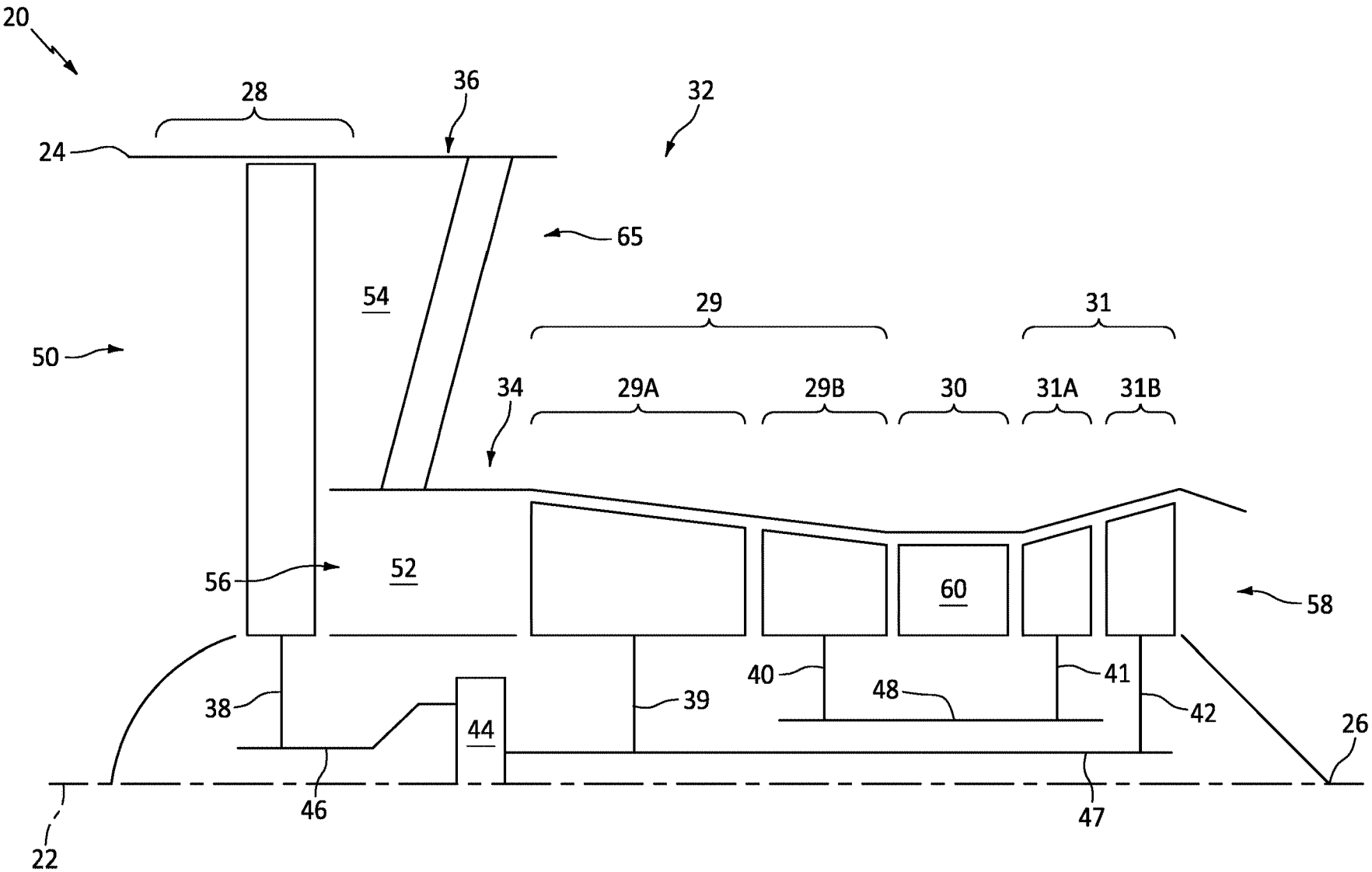
FIG. 1 is a partial schematic illustration of a gas turbine engine.

FIG. 1 is a side sectional illustration of a gas turbine engine 20 for an aircraft propulsion system. This turbine engine 20 extends axially along an axial centerline 22 between a forward, upstream end 24 and an aft, downstream end 26. The turbine engine 20 includes a fan section 28, a compressor section 29, a combustor section 30 and a turbine section 31. The compressor section 29 of FIG. 1 includes a low pressure compressor (LPC) section 29A and a high pressure compressor (HPC) section 29B. The turbine section 31 of FIG. 1 includes a high pressure turbine (HPT) section 31A and a low pressure turbine (LPT) section 31B.

The engine sections 28-31B of FIG. 1 are arranged sequentially along the axial centerline 22 within an engine housing 32. This engine housing 32 includes an inner case 34 (e.g., a core case) and an outer case 36 (e.g., a fan case). The inner case 34 may house one or more of the engine sections 29A-31B; e.g., a core of the turbine engine 20. The outer case 36 may house at least the fan section 28.

Each of the engine sections 28, 29A, 29B, 31A and 31B includes a respective bladed rotor 38-42. Each of these bladed rotors 38-42 includes a plurality of rotor blades arranged circumferentially around and connected to one or more respective rotor disks and/or hubs. The rotor blades, for example, may be formed integral with or mechanically fastened, welded, brazed, adhered and/or otherwise attached to the respective rotor disk(s) and/or the respective hub(s).

The fan rotor 38 is connected to a geartrain 44, for example, through a fan shaft 46. The geartrain 44 and the LPC rotor 39 are connected to and driven by the LPT rotor 42 through a low speed shaft 47. The HPC rotor 40 is connected to and driven by the HPT rotor 41 through a high speed shaft 48. The engine shafts 46-48 are rotatably supported by a plurality of bearings; e.g., rolling element and/or thrust bearings. Each of these bearings is connected to the engine housing 32 by at least one stationary structure such as, for example, an annular support strut.

During engine operation, air enters the turbine engine 20 through an airflow inlet into the turbine engine 20. This air is directed through the fan section 28 and into a core flowpath 52 and a bypass flowpath 54. The core flowpath 52 extends sequentially through the engine sections 29A-31B (e.g., the engine core) from an inlet 56 into the core flowpath 52 to an exhaust 58 from the core flowpath 52. The air within the core flowpath 52 may be referred to as "core air". The bypass flowpath 54 extends through a bypass duct, and bypasses the engine core. The air within the bypass flowpath 54 may be referred to as "bypass air".

The core air is compressed by the LPC rotor 39 and the HPC rotor 40 and directed into a combustion zone 60 within the combustor section 30. Fuel is injected into the combustion zone 60 and mixed with the compressed core air to provide a fuel-air mixture. This fuel-air mixture is ignited and combustion products thereof flow through and sequentially cause the HPT rotor 41 and the LPT rotor 42 to rotate before being directed out of the turbine engine 20 through the core exhaust 58. The rotation of the HPT rotor 41 and the LPT rotor 42 respectively drive rotation of the HPC rotor 40 and the LPC rotor 39 and, thus, compression of the air received from the core inlet 56. The rotation of the LPT rotor 42 also drives rotation of the fan rotor 38, which propels the bypass air through the bypass flowpath 54 and out of the turbine engine 20 through an exhaust 65 from the bypass flowpath 54. The propulsion of the bypass air may account for a majority of thrust generated by the turbine engine 20.

Figure 2:
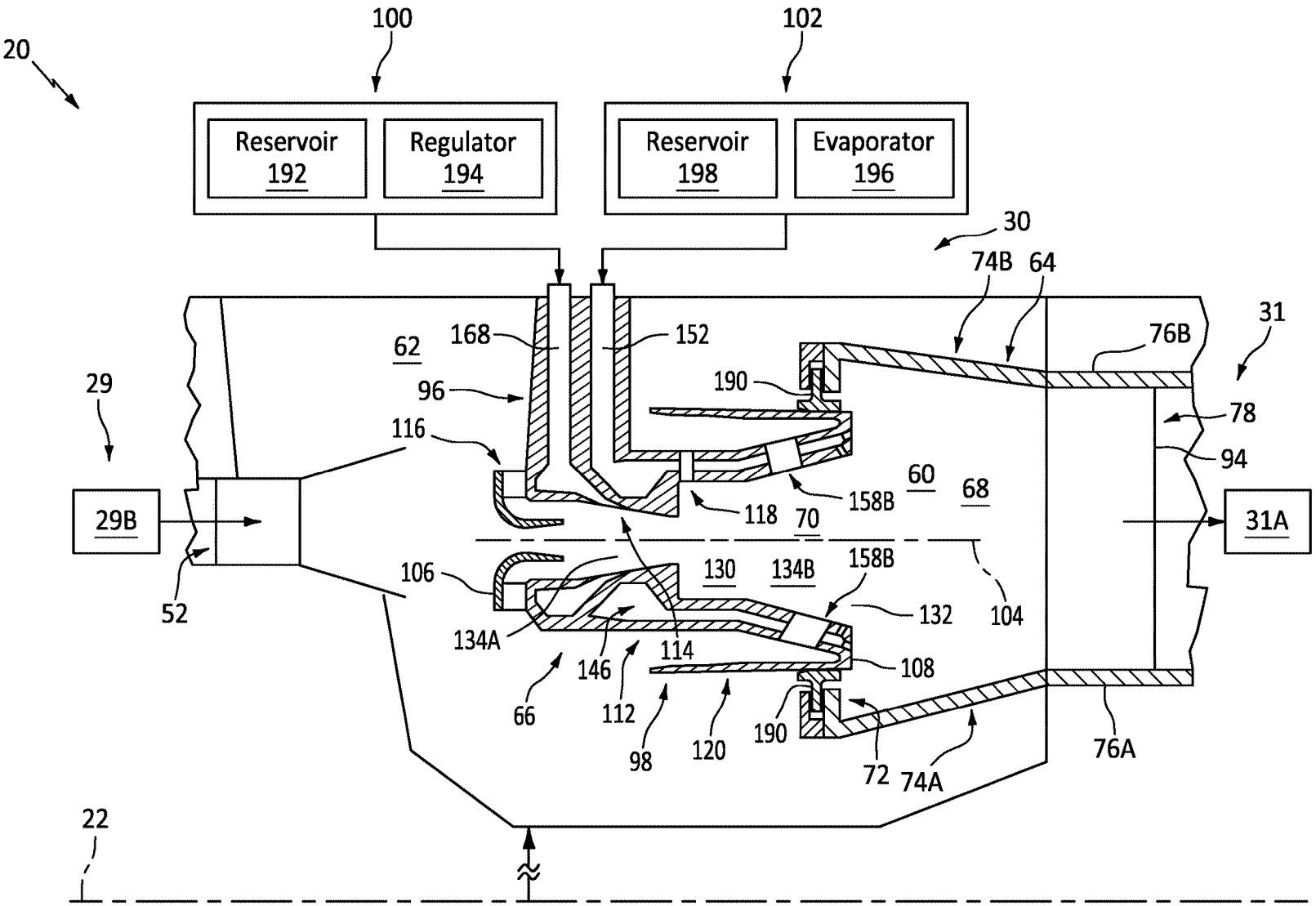
FIG. 2 is a partial schematic illustration of a combustor section between a compressor section and a turbine section.

FIG. 2 illustrates a portion of the combustor section 30 along the core flowpath 52 between the HPC section 29B and the HPT section 31A. This combustor section 30 includes a diffuser plenum 62, a combustor 64 and one or more fuel-air mixers 66 (one visible in FIG. 2). Briefly, the combustor 64 and the fuel-air mixers 66 are disposed within (e.g., surrounded by) the diffuser plenum 62. The diffuser plenum 62 is configured to receive compressed core air from the HPC section 29B for subsequent provision into the combustion zone 60. The combustion zone 60 of FIG. 2 includes a combustion chamber 68 within the combustor 64. This combustion zone 60 may also include an internal volume 70 within the each of the fuel-air mixers 66.

The combustor 64 may be configured as an annular combustor; e.g., an annular floating wall combustor. The combustor 64 of FIGS. 2 and 3, for example, includes an annular combustor bulkhead 72, a tubular inner combustor wall 74A ("inner wall") and a tubular outer combustor wall 74B ("outer wall"). The bulkhead 72 of FIG. 2 extends radially between and to the inner wall 74A and the outer wall 74B. The bulkhead 72 may be connected (e.g., mechanically fastened or otherwise attached) to the inner wall 74A and/or the outer wall 74B. Each combustor wall 74A, 74B (generally referred to as "74") projects axially along the axial centerline 22 out from the bulkhead 72 towards the HPT section 31A. The inner wall 74A of FIG. 2, for example, projects axially to and may be connected to an inner platform 76A of a downstream stator vane array 78 (e.g., a turbine inlet nozzle) in the HPT section 31A. The outer wall 74B of FIG. 2 projects axially to and may be connected to an outer platform 76B of the downstream stator vane array 78. With the arrangement of FIG. 2, the combustion chamber 68 is formed by and extends radially within the combustor 64 between and to the inner wall 74A and the outer wall 74B. The combustion chamber 68 is formed by and extends axially (in an upstream direction along the core flowpath 52) into the combustor 64 from the stator vane array 78 to the bulkhead 72. The combustion chamber 68 also extends within the combustor 64 circumferentially about (e.g., completely around) the axial centerline 22, which may configure the combustion chamber 68 as a full-hoop annulus.

For ease of description, the combustion chamber 68 may be described below as having the above annular configuration. The combustor 64 of the present disclosure, however, is not limited to such an exemplary arrangement. For example, referring to FIG. 4, the combustor 64 may alternatively include/be divided into one or more combustor modules 80; e.g., circumferential sections. Each combustor module 80 may include a circumferential (e.g., arcuate) section of the bulkhead 72, a circumferential (e.g., arcuate) section of the inner wall 74A and a circumferential (e.g., arcuate) section of the outer wall 74B. While the wall sections are described above as sections of a common wall 72, 74A, 74B, each wall section may alternatively be configured as a standalone component from the other line wall sections.

Figure 4:
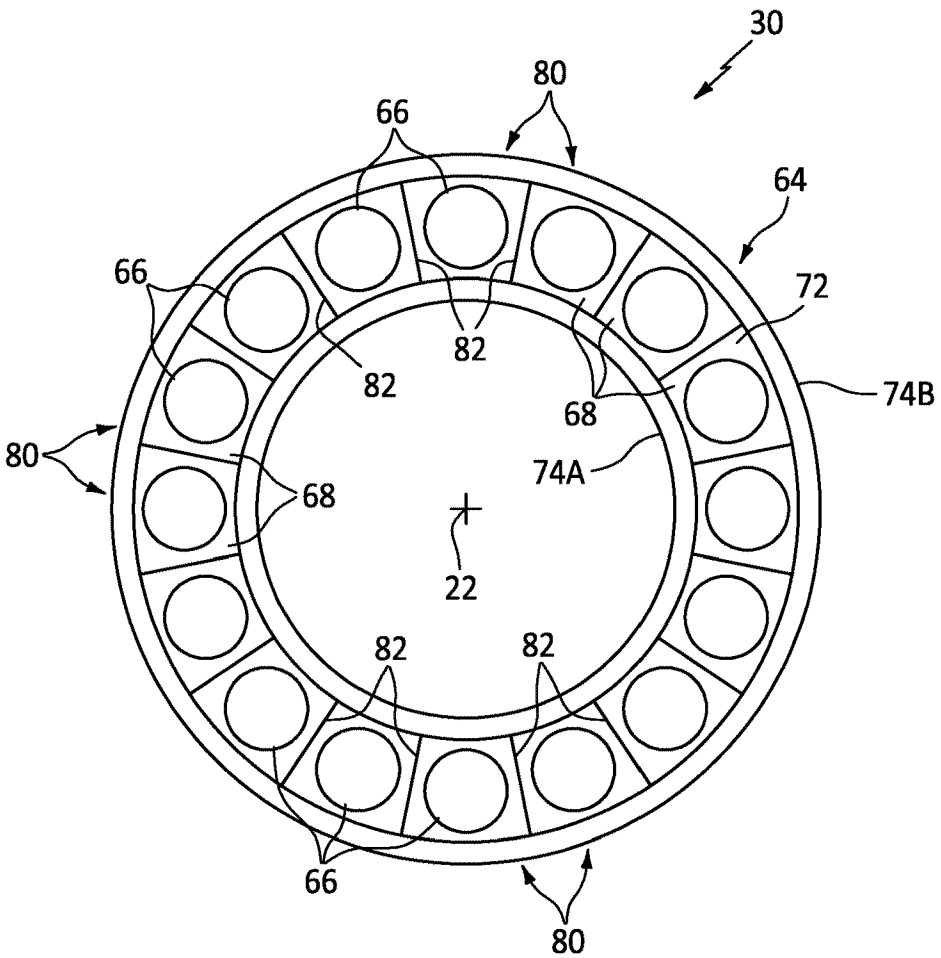
FIG. 4 is a schematic illustration of the combustor section with a modular combustor.

The combustor 64 of FIG. 4 also includes a plurality of dividers 82 arranged circumferentially about the axial centerline 22 in an array. Each of these dividers 82 is configured to circumferentially divide the combustor 64 into the combustor modules 80. Each divider 82 of FIG. 4, in particular, is disposed at a circumferential interface and/or joint between a respective circumferentially neighboring (e.g., adjacent) pair of the combustor modules 80. Each divider 82 may be formed by a single divider wall such that each circumferentially neighboring pair of the combustor modules 80 shares a common divider wall. Alternatively, each divider 82 may be formed by a pair of parallel divider walls such that each circumferentially neighboring pair of the combustor modules 80 has its own divider wall at a respective divider location. With either arrangement, each combustor module 80 is configured with its own arcuate combustion chamber 68. This combustion chamber 68 may extend axially and radially as discussed above. However, instead of extending completely circumferentially around the axial centerline 22, each arcuate combustion chamber 68 extends circumferentially partially about the axial centerline 22 within a respective combustor module 80 between its dividers 82. With such an arrangement, the core flowpath 52 is divided into a plurality of parallel legs within the combustor 64 until reaching, for example, an upstream end or a downstream end of the stator vane array 78.

Figure 5:
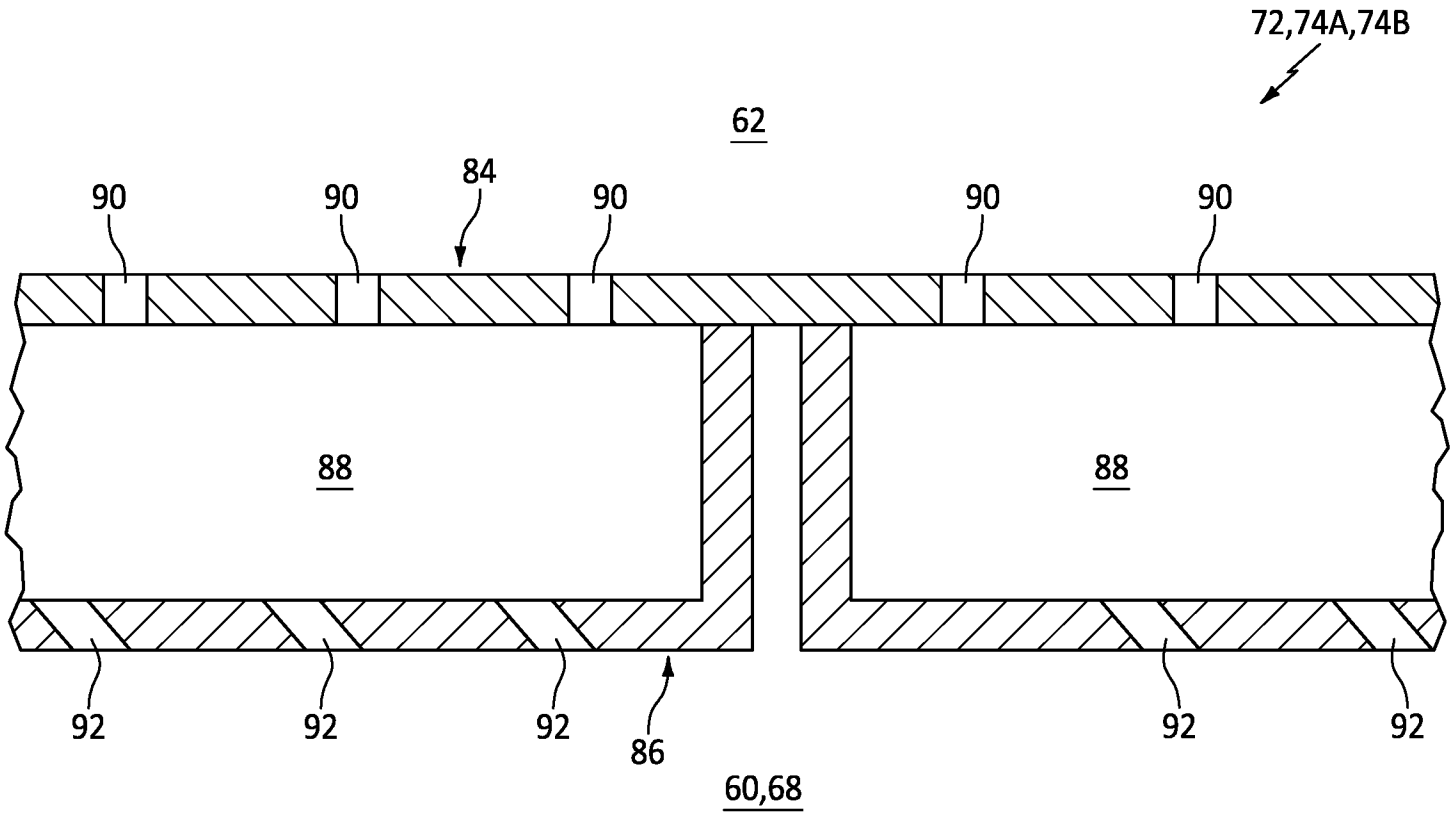
FIG. 5 is a partial sectional illustration of a combustor wall.

Referring to FIG. 5, any one or more or all of the walls 72, 74A and/or 74B may each be configured as a multi-walled structure; e.g., a hollow, dual-walled structure. For example, each wall 72, 74A, 74B of FIG. 5 includes a combustor wall shell 84, a combustor wall heat shield 86 (e.g., a liner) and one or more combustor wall cooling cavities 88 (e.g., impingement cavities) formed by and (e.g., radially and/or axially) between the shell 84 and the heat shield 86. Each cooling cavity 88 of FIG. 5 is fluidly coupled with the diffuser plenum 62 through one or more cooling apertures 90 in the shell 84; e.g., impingement apertures. Each cooling cavity 88 of FIG. 5 is fluidly coupled with the combustion chamber 68 through one or more cooling apertures 92 in the heat shield 86; e.g., effusion apertures. Of course, various other multi-walled combustor wall structures are known in the art, and the present disclosure is not limited to any particular ones thereof. Furthermore, it is contemplated any one or more or all of the walls 72, 74A and/or 74B of FIG. 2 may each alternatively be configured as a single-walled structure. The shell 84 (see FIG. 5) for example, may be omitted and the heat shield 86 may form a single walled liner/wall. However, for ease of description, each wall 72, 74A, 74B may each be described below as the hollow, dual-walled structure.

The stator vane array 78 or FIG. 2 includes the inner platform 76A, the outer platform 76B and a plurality of stator vanes 94 (one visible in FIG. 2). The stator vanes 94 are arranged circumferentially about the axial centerline 22 in an array; e.g., a circular array. Each of these stator vanes 94 extends radially across the core flowpath 52 between and to the inner platform 76A and the outer platform 76B. Each of the stator vanes 94 may also be connected to the inner platform 76A and/or the outer platform 76B. The stator vane array 78 and its stator vanes 94 are configured to turn and/or otherwise condition the combustion products exiting the combustion zone 60 for interaction with a first stage of the HPT rotor 41 (see FIG. 1).

Figure 3:
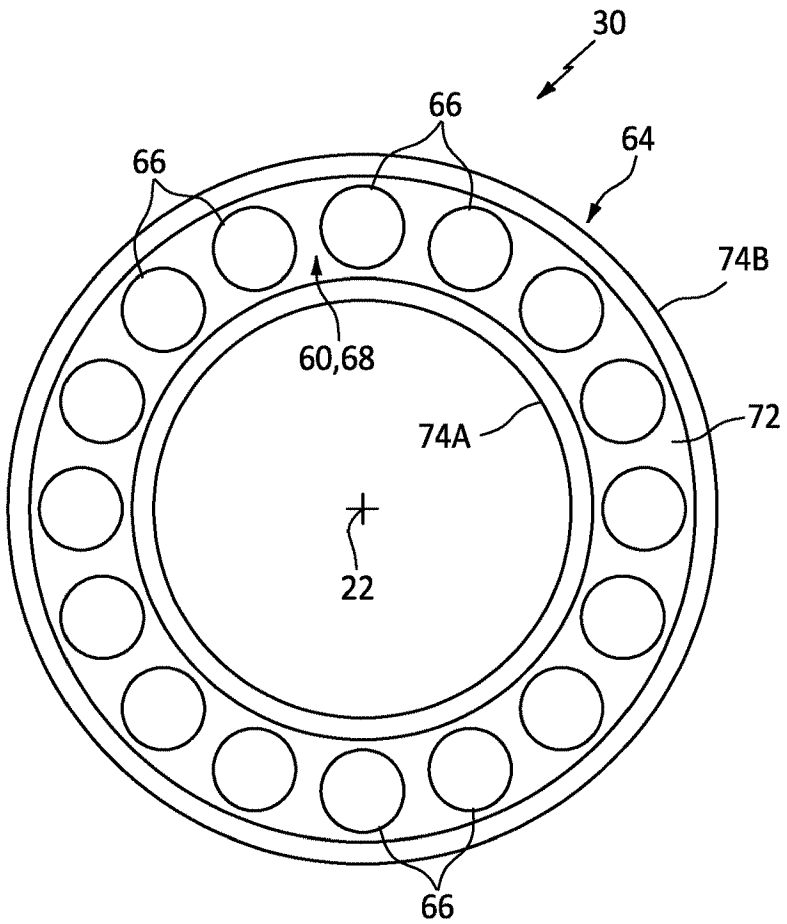
FIG. 3 is a schematic illustration of the combustor section with an annular combustor.

Referring to FIGS. 3 and 4, the fuel-air mixers 66 are arranged circumferentially about the axial centerline 22 in an array; e.g., a circular array. Within this array, the fuel-air mixers 66 may be equally spaced by a common circumferential inter-mixer distance. The present disclosure, however, is not limited to such an exemplary equidistance fuel-air mixer arrangement.

Figure 6:
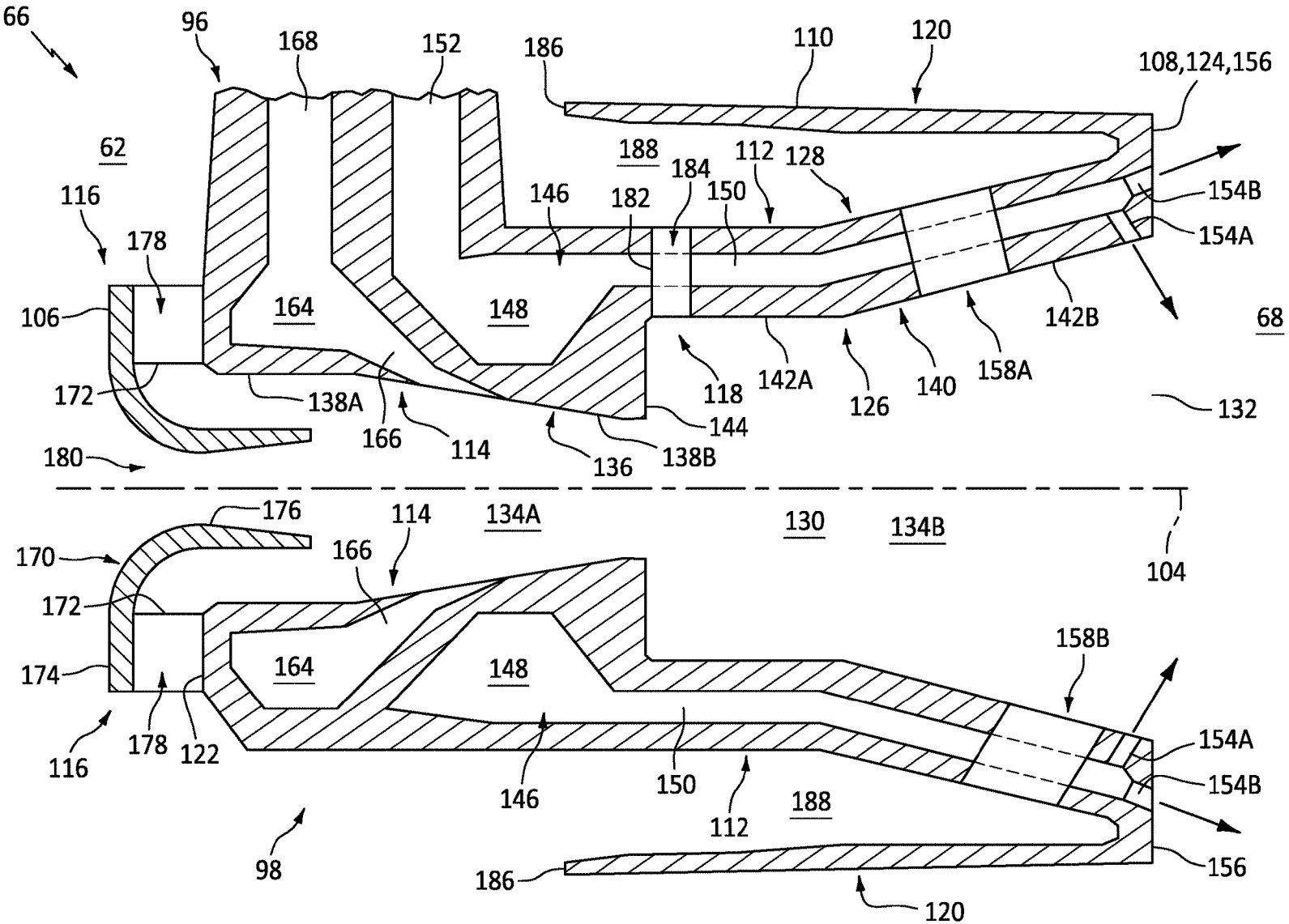
FIG. 6 is a partial sectional illustration of a fuel-air mixer.

Each fuel-air mixer 66 of FIG. 2 includes a mixer stem 96 and a tubular mixer body 98. The mixer stem 96 is configured to support and route fuel from a fuel source 100 and steam from a steam source 102 to the mixer body 98. Referring to FIG. 6, the mixer body 98 is connected to and may be cantilevered from the mixer stem 96. The mixer body 98 of FIG. 6 extends axially along a centerline axis 104 of the mixer body 98 from an upstream end 106 of the fuel-air mixer 66 and its mixer body 98 to a downstream end 108 of the fuel-air mixer 66 and its mixer body 98. The mixer body 98 projects radially out to an outer side 110 of the mixer body 98. The mixer body 98 of FIG. 6 includes a tubular mixer sidewall 112, a fuel nozzle 114 and one or more air swirlers 116 and 118. The mixer body 98 may also include a mixer mount 120.

The mixer sidewall 112 of the FIG. 6 extends axially along the axis 104 between and to an upstream end 122 of the mixer sidewall 112 and a downstream end 124 of the mixer sidewall 112, which axis 104 may also be a centerline axis of the mixer sidewall 112. The sidewall upstream end 122 of FIG. 6 is axially offset (e.g., recessed from) the mixer upstream end 106. The sidewall downstream end 124 of FIG. 6 is axially aligned with the mixer downstream end 108. The mixer sidewall 112 extends radially between and to an inner side 126 of the mixer sidewall 112 and an outer side 128 of the mixer sidewall 112. The mixer sidewall 112 extends circumferentially about (e.g., completely around) the axis 104 thereby forming an inner passage 130 (e.g., a center mixer passage) within the mixer body 98.

The inner passage 130 extends axially along the axis 104 within the mixer body 98, which axis 104 may also be a centerline axis of the inner passage 130. The inner passage 130 of FIG. 6, for example, projects axially through an interior of the mixer sidewall 112 (e.g., out of the fuel-air mixer 66 and its mixer body 98) from the sidewall upstream end 122 to an outlet orifice 132 from the inner passage 130 at the sidewall downstream end 124/the mixer downstream end 108. Briefly, referring to FIG. 2, this passage outlet orifice 132 fluidly couples the inner passage 130 to the combustion chamber 68. Referring again to FIG. 6, the inner passage 130 may include one or more passage segments 134A and 134B (generally referred to as "134") along the axis 104.

The upstream passage segment 134A extends axially within the mixer body 98 from the sidewall upstream end 122 to the downstream passage segment 134B. The upstream passage segment 134A projects radially out from the axis 104 to a tubular inner first surface 136 of the mixer body 98 and its mixer sidewall 112. An upstream portion 138A of the first surface 136 may be provided with a uniform width (e.g., constant diameter) along the axis 104. A downstream portion 138B of the first surface 136 may be provided with a variable width (e.g., changing diameter) along the axis 104. With this arrangement, the upstream passage segment 134A may (e.g., continuously) radially taper inward towards the axis 104 as the inner passage 130 and its upstream passage segment 134A extend axially along the axis 104 away from the mixer upstream end 106 (e.g., and the upstream air swirler 116) and towards the mixer downstream end 108 (e.g., and the downstream air swirler 118); e.g., from the upstream portion 138A of the first surface 136 to or about the downstream passage segment 134B.

The downstream passage segment 134B extends axially within the mixer body 98 from the upstream passage segment 134A to passage outlet orifice 132. The downstream passage segment 134B projects radially out from the axis 104 to a tubular inner second surface 140 of the mixer body 98 and its mixer sidewall 112. An upstream portion 142A of the second surface 140 may be provided with a uniform width (e.g., constant diameter) along the axis 104. A downstream portion 142B of the second surface 140 may be provided with a variable width (e.g., changing diameter) along the axis 104. With this arrangement, the downstream passage segment 134B may (e.g., continuously) radially expand (e.g., flare) outward away from the axis 104 as the inner passage 130 and its downstream passage segment 134B extend axially along the axis 104 away from the mixer upstream end 106 (e.g., and the mixer elements 114, 116, 118) and towards (e.g., to) the mixer downstream end 108; e.g., from the upstream portion 142A of the second surface 140 to or about the passage outlet orifice 132.

Each of the passage segments 134 may be configured as an inner bore of the mixer sidewall 112. However, the downstream passage segment 134B of FIG. 6 may also be a counterbore to the upstream passage segment 134A. An annular shelf 144, for example, projects radially outward from the first surface 136 to the second surface 140 at an intersection between the passage segments 134A and 134B. This shelf 144 may be perpendicular to the axis 104; however, the present disclosure is not limited thereto.

The mixer sidewall 112 of FIG. 6 is configured with a (e.g., annular) steam passage 146 embedded within the mixer sidewall 112. This steam passage 146 is disposed/formed within the mixer sidewall 112 between the sidewall inner side 126 and the sidewall outer side 128. The steam passage 146 of FIG. 6, for example, may be a micro-circuit with a steam plenum 148 and a steam channel 150.

The steam plenum 148 is axially aligned with (e.g., axially overlaps) the upstream passage segment 134A and at least the downstream portion 138B of the first surface 136. The steam plenum 148 extends radially within the mixer body 98 and its mixer sidewall 112. The steam plenum 148 extends axially along the axis 104 within the mixer body 98 and its mixer sidewall 112 from a steam supply passage 152 in the mixer stem 96 to the steam channel 150. The steam plenum 148 extends circumferentially about (e.g., completely around) the axis 104 within the mixer body 98 and its mixer sidewall 112, for example circumscribing the upstream passage segment 134A.

The steam channel 150 is axially aligned with (e.g., axially overlaps) the downstream passage segment 134B and the second surface 140. The steam channel 150 extends radially within the mixer body 98 and its mixer sidewall 112. The steam channel 150 extends axially along the axis 104 within the mixer body 98 and its mixer sidewall 112 from the steam plenum 148 to an axial distal end of the steam passage 146 at (e.g., on, adjacent or proximate) the mixer downstream end 108. The steam channel 150 extends circumferentially about (e.g., completely around) the axis 104 within the mixer body 98 and its mixer sidewall 112, for example circumscribing the downstream passage segment 134B.

Figure 7:
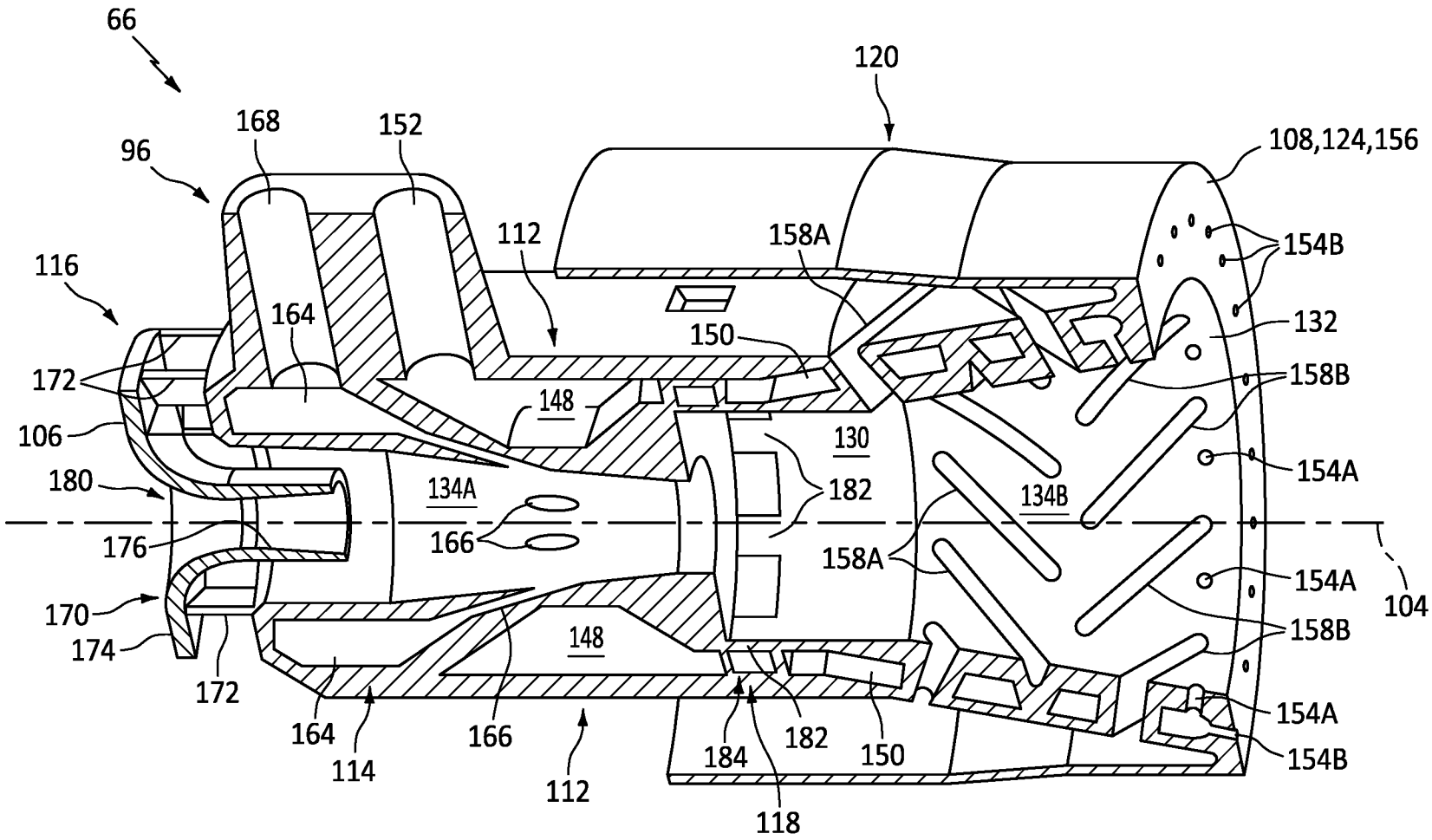
FIG. 7 is a partial perspective cutaway illustration of the fuel-air mixer.

One or more radial steam outlets 154A may be provided to fluidly couple the steam passage 146 and its steam channel 150 to the inner passage 130. Referring to FIG. 7, the radial steam outlets 154A may be arranged circumferentially about the axis 104 in an array (e.g., a circular array) at or near the mixer downstream end 108 and/or the passage outlet orifice 132. Each radial steam outlet 154A of FIG. 6 projects radially out from the steam passage 146 and its steam channel 150 (in a radial inward direction) to a respective outlet orifice in the second surface 140. Each radial steam outlet 154A is configured to exhaust steam received from the steam passage 146 and its steam channel 150 into the inner passage 130 in a radial inward direction towards the axis 104. Here, the steam is also exhausted from the radial steam outlet 154A (e.g., slightly) in an axial downstream direction; e.g., axially towards the passage outlet orifice 132. However, a radial component of a trajectory of the exhausted steam may be (e.g., significantly) greater than an axial component of the exhausted steam trajectory. Of course, in other embodiments, the axial component of the exhausted steam trajectory may be equal to or greater than the radial component of the exhausted steam trajectory. In still other embodiments, the exhausted steam trajectory may be perpendicular to the axis 104.

One or more axial steam outlets 154B may also or alternatively be provided to fluidly couple the steam passage 146 and its steam channel 150 to the combustion chamber 68 (see also FIG. 2). Referring to FIG. 7, the axial steam outlets 154B may be arranged circumferentially about the axis 104 in an array (e.g., a circular array) at the mixer downstream end 108. Each axial steam outlet 154B of FIG. 6 projects axially out from the steam passage 146 and its steam channel 150 (in an axial downstream direction) to a respective outlet orifice in an annular surface 156 at the mixer downstream end 108. Each axial steam outlet 154B is configured to exhaust steam received from the steam passage 146 and its steam channel 150 into the combustion chamber 68 (see also FIG. 2) in the axial downstream direction away and out from the fuel-air mixer 66. Here, the steam is also exhausted from the axial steam outlet 154B (e.g., slightly) in a radial direction; e.g., radially away from the axis 104 and the passage outlet orifice 132. However, an axial component of a trajectory of the exhausted steam may be (e.g., significantly) greater than a radial component of the exhausted steam trajectory. Of course, in other embodiments, the radial component of the exhausted steam trajectory may be equal to or greater than the axial component of the exhausted steam trajectory. In still other embodiments, the exhausted steam trajectory may be parallel with the axis 104.

The mixer body 98 and its mixer sidewall 112 of FIGS. 6 and 7 may also be configured with one or more quench apertures 158A and 158B (generally referred to as "158"). The upstream quench apertures 158A are arranged circumferentially about the axis 104 in an upstream array; e.g., a circular array. The downstream quench apertures 158B are arranged circumferentially about the axis 104 in a downstream array (e.g., a circular array), where the downstream array and its downstream quench apertures 158B are arranged downstream of the upstream array and its upstream quench apertures 158A along the inner passage 130. Within each of the arrays, the quench apertures 158 may be equally spaced by a common circumferential inter-aperture distance. The present disclosure, however, is not limited to such an exemplary equidistance quench aperture arrangement.

Referring to FIG. 7, the upstream quench apertures 158A may be circumferentially offset from the downstream quench apertures 158B about the axis 104. A center of one or more or all of the upstream quench apertures 158A, for example, may be circumferentially offset from a center of each downstream quench aperture 158B about the axis 104. Similarly, a center of one or more or all of the downstream quench apertures 158B may be circumferentially offset from a center of each upstream quench aperture 158A about the axis 104. Depending upon spacing between the quench apertures 158 within the arrays, each upstream quench aperture 158A may (or may not) partially circumferentially overlap one or more of the downstream quench apertures 158B.

Referring to FIG. 6, each quench aperture 158 extends radially through the mixer sidewall 112 from an inlet orifice into the respective quench aperture 158 to an outlet orifice from the respective quench aperture 158. The inlet orifice is disposed at the sidewall outer side 128. The outlet orifice is disposed at the sidewall inner side 126, for example, in the second surface 140 and towards the mixer downstream end 108 and/or the passage outlet orifice 132.

Figure 8B:
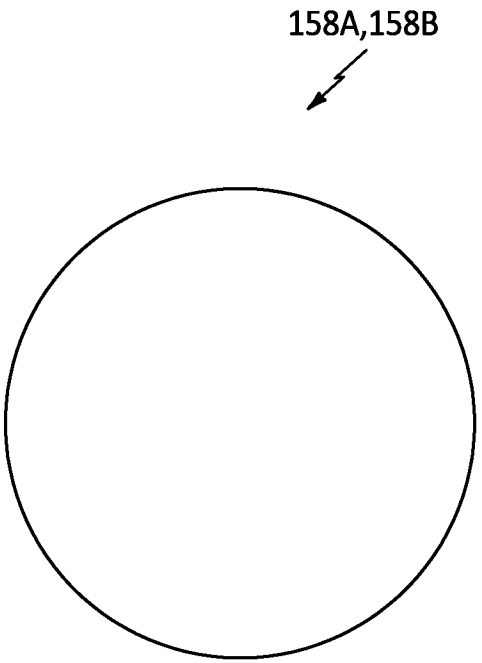
FIGS. 8A and 8B are schematic illustrations of various quench aperture geometries.
Figure 8A:
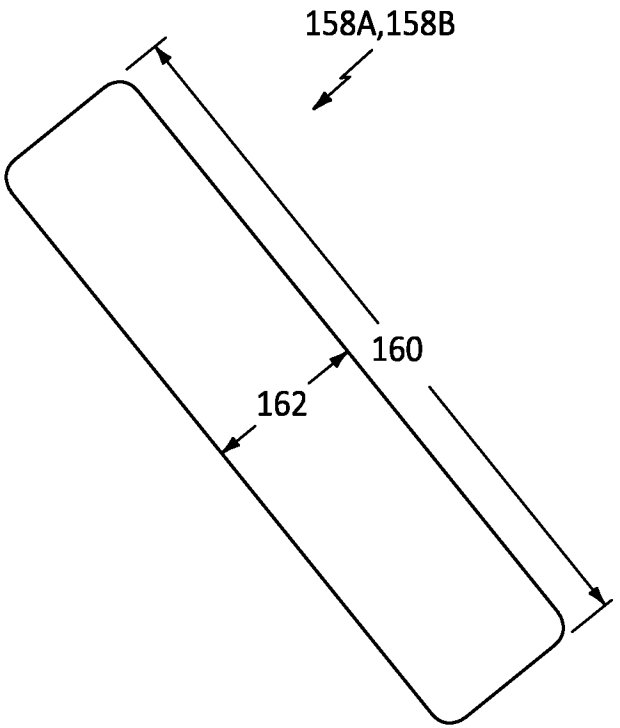

Referring to FIGS. 8A and 8B, each quench aperture 158 has a cross-sectional geometry; e.g., shape and size. The cross-sectional geometry of each quench aperture 158 in the same array may be uniform; e.g., the same. Alternatively, the cross-sectional geometry of one or more of the quench apertures 158 may be different (e.g., in shape and/or size) than the cross-sectional geometry of one or more other quench apertures 158 in the same array. Furthermore, the cross-sectional geometry of all the quench apertures 158 may be uniform. Alternatively, the cross-sectional geometry of one or more or all of the upstream quench apertures 158A may be different (e.g., in shape and/or size) than the cross-sectional geometry of one or more or all of the downstream quench apertures 158B.

In some embodiments, referring to FIG. 8A (see also FIG. 7), one or more or all of the quench apertures 158 may each have an elongated cross-sectional geometry when viewed, for example, in a reference plane perpendicular to a centerline of the respective quench aperture. This elongated cross-sectional geometry may have a major axis dimension 160 that is greater than a minor axis dimension 162. The elongated cross-sectional geometry may have a slot shape, an oval shape, a rectangular shape or any other elongated curved and/or polygonal shape.

In some embodiments, referring to FIG. 8B, one or more or all of the quench apertures 158 may each have a regular cross-sectional geometry (e.g., a non-elongated cross-sectional geometry) when viewed, for example, in a reference plane perpendicular to a centerline of the respective quench aperture. Here, a "regular" shape may describe a shape with equal length sides that are symmetrically placed about a center of the shape. The regular cross-sectional geometry, for example, may have a circular shape, a square shape or any other regular curved and/or polygonal shape.

Referring to FIG. 6, the fuel nozzle 114 may be integrated with (e.g., formed as a part of, included in a common structure with) the mixer body 98. The fuel nozzle 114 of FIG. 6, for example, may be a micro-circuit with a fuel plenum 164 and one or more fuel nozzle outlets 166.

The fuel plenum 164 may be embedded within the mixer sidewall 112. The fuel plenum 164 of FIG. 6, for example, is disposed/formed within the mixer sidewall 112 between the sidewall inner side 126 and the sidewall outer side 128. This fuel plenum 164 is axially aligned with (e.g., axially overlaps, overlapped by) the upstream passage segment 134A, at least the upstream portion 138A of the first surface 136, and the mixer stem 96. The fuel plenum 164 extends axially along the axis 104 within the mixer body 98 and its mixer sidewall 112 to the fuel nozzle outlets 166. The fuel plenum 164 extends radially within the mixer body 98 and its mixer sidewall 112 between a fuel supply passage 168 in the mixer stem 96 and the fuel nozzle outlets 166. The fuel plenum 164 extends circumferentially about (e.g., completely around) the axis 104 within the mixer body 98 and its mixer sidewall 112, for example circumscribing the upstream passage segment 134A.

The fuel nozzle 114 and its fuel plenum 164 of FIG. 6 may be positioned axially along the axis 104 between the upstream air swirler 116 and the downstream air swirler 118. The fuel nozzle 114 and its fuel plenum 164 may be positioned axially along the axis 104 between the upstream air swirler 116 and the mixer downstream end 108. The fuel nozzle 114 and its fuel plenum 164 may be positioned axially along the axis 104 between the mixer upstream end 106 and the downstream air swirler 118.

The fuel nozzle outlets 166 fluidly couple the fuel plenum 164 to the inner passage 130. Referring to FIG. 7, the fuel nozzle outlets 166 may be arranged circumferentially about the axis 104 in an array (e.g., a circular array) at or near the mixer upstream end 106. Each fuel nozzle outlet 166 of FIG. 6 projects radially out from the fuel plenum 164 (in a radial inward direction) to a respective outlet orifice in the first surface 136. Each fuel nozzle outlet 166 is configured to inject fuel received from the fuel plenum 164 into the inner passage 130 in a radial inward direction towards the axis 104. Here, the fuel is also injected from the fuel nozzle outlet 166 in an axial downstream direction; e.g., axially towards the passage outlet orifice 132. A radial component of a trajectory of the injected fuel may be less than an axial component of the injected fuel trajectory. Of course, in other embodiments, the axial component of the injected fuel trajectory may be equal to or less than the radial component of the injected fuel trajectory. In still other embodiments, the injected fuel trajectory may be perpendicular to the axis 104.

The upstream air swirler 116 may be arranged at the mixer upstream end 106. This upstream air swirler 116 may be integrated with the mixer body 98, or alternatively attached to the mixer body 98. The upstream air swirler 116 of FIG. 6, for example, includes a swirler guide 170 and one or more swirler vanes 172.

Referring to FIG. 7, the swirler guide 170 extends circumferentially about (e.g., completely around) the axis 104. Referring to FIG. 6, the swirler guide 170 includes an annular outer segment 174 and a tubular inner segment 176. The outer segment 174 is disposed at the mixer upstream end 106 and projects radially outward from the inner segment 176. The inner segment 176 projects axially into (or extends axially within) the inner passage 130 at the sidewall upstream end 122. With this arrangement, the swirler guide 170 forms an annular upstream swirler passage 178 with the mixer sidewall 112. An upstream portion of the upstream swirler passage 178 is formed by and extends axially between the outer segment 174 and the sidewall upstream end 122. A downstream portion of the upstream swirler passage 178 is formed by and extends radially between the inner segment 176 and the first surface 136. In addition, an inner bore 180 through the swirler guide 170 may form a center inlet into the inner passage 130 from the diffuser plenum 62 (see also FIG. 2).

The swirler vanes 172 are arranged circumferentially about the axis 104 in an array; e.g., a circular array. Each of these swirler vanes 172 is connected to and extends axially between the swirler guide 170 and its outer segment 174 and the mixer sidewall 112. Each of the swirler vanes 172 thereby axially crosses the upstream swirler passage 178. The swirler vanes 172 are arranged to impart swirl onto the compressed core air directed through the upstream swirler passage 178 from the diffuser plenum 62 into the inner passage 130. The swirl may be imparted in a clockwise or counterclockwise direction about the axis 104.

The downstream air swirler 118 may be arranged at an intermediate location (e.g., at or about an axial center) between the mixer upstream end 106 and the mixer downstream end 108. This downstream air swirler 118 may be integrated with the mixer body 98. The downstream air swirler 118 of FIG. 6, for example, includes one or more swirler vanes 182 arranged within a downstream swirler passage 184. This downstream swirler passage 184 may be an annular passage, and extends radially through the mixer sidewall 112 from an inlet orifice into the downstream swirler passage 184 to an outlet orifice from the downstream swirler passage 184. The inlet orifice is disposed at the sidewall outer side 128. The outlet orifice is disposed at the sidewall inner side 126, for example in the second surface 140 and axially adjacent (or proximate) the shelf 144.

The swirler vanes 182 are arranged circumferentially about the axis 104 in an array; e.g., a circular array. Each of these swirler vanes 182 is connected to and extends axially between axially opposing portions of the mixer sidewall 112; e.g., between opposing axial sidewalls forming the downstream swirler passage 184. Each of the swirler vanes 182 thereby axially crosses the downstream swirler passage 184. The swirler vanes 182 are arranged to impart swirl onto the compressed core air directed through the downstream swirler passage 184 from the diffuser plenum 62 into the inner passage 130. The swirl may be imparted in a clockwise or counterclockwise direction about the axis 104, which may be the same direction as the swirl imparted by the upstream air swirler 116.

Figure 9:
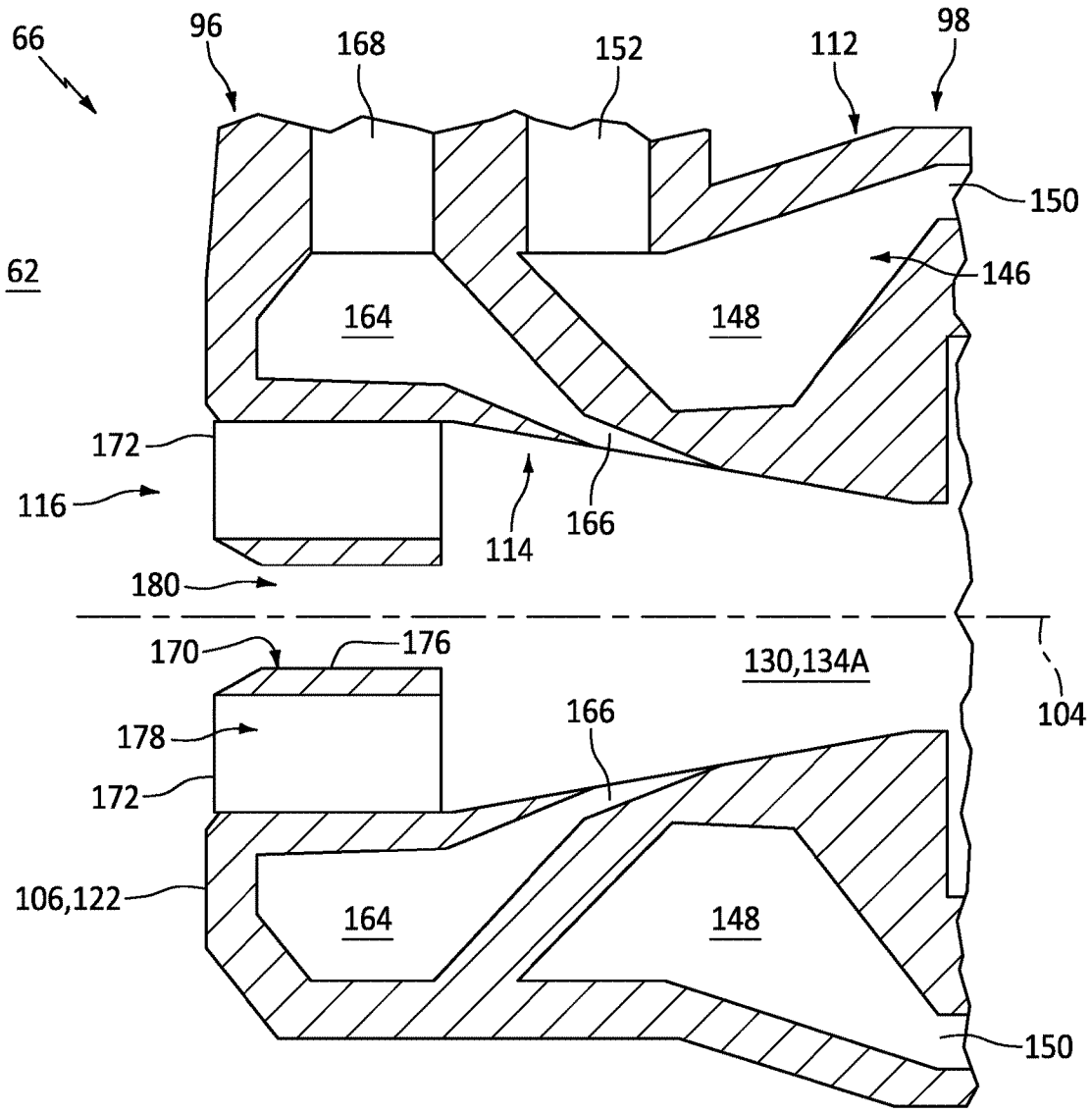
FIG. 9 is a partial sectional illustration of the fuel-air mixer with an axial air swirler.

Both of the air swirlers 116 and 118 are described above as radial air swirlers. In other embodiments, however, it is contemplated that the fuel-air mixer 66 may also or alternatively include one or more axial air swirlers. For example, referring to FIG. 9 the swirler guide 170 of the upstream air swirler 116 may be configured without the outer segment 174 (see FIG. 6). With such an arrangement, the swirler vanes 172 may be connected to and extend radially between the swirler guide 170 and the mixer sidewall 112. Here, the swirler vanes 172 are also circumscribed by the mixer sidewall 112 and/or also disposed within the inner passage 130 at the mixer upstream end 106.

Referring to FIG. 6, the mixer mount 120 may be connected to the mixer sidewall 112 at the mixer downstream end 108. This mixer mount 120 projects axially along the axis 104 from the mixer downstream end 108, along the mixer sidewall 112, to a distal end 186 which is axially spaced from the mixer stem 96. The mixer mount 120 is spaced radially outboard from the mixer sidewall 112. The mixer mount 120 of FIG. 6 extends circumferentially about (e.g., completely around, circumscribes) the mixer sidewall 112. With this arrangement, an annular feed volume 188 is formed radially between the mixer sidewall 112 and the mixer mount 120. This feed volume 188 fluidly couples the diffuser plenum 62 (see also FIG. 2) with the quench apertures 158.

Referring to FIG. 2, each fuel-air mixer 66 is mated with the combustor 64. More particularly, each fuel-air mixer 66 and its mixer body 98 is mated with the bulkhead 72. The mixer body 98 of FIG. 2, for example, projects axially along the axis 104 through (or partially into) an aperture in the bulkhead 72. Each fuel-air mixer 66 and its mixer body 98 may be attached to the combustor 64 and its bulkhead 72 using a guide plate 190. This guide plate 190 circumscribes the mixer mount 120. The guide plate 190 of FIG. 2 radially engages (e.g., contacts) the mixer mount 120, and may be configured to move (e.g., translate, slide) axially along the mixer mount 120. The guide plate 190 may also be moveably coupled to the combustor 64 and its bulkhead 72. The guide plate 190 of FIG. 2, for example, may be retained (e.g., within a slot) to facilitate radial movement of the guide plate 190 relative to the bulkhead 72. The present disclosure, however, is not limited to such an exemplary attachment technique.

During operation of the combustor section 30 of FIG. 2, each fuel-air mixer 66 receives the fuel from the fuel source 100 and compressed core air from the diffuser plenum 62. At each fuel-air mixer 66, the fuel nozzle 114 injects the fuel into the inner passage 130 and its upstream passage segment 134A. The upstream air swirler 116 directs the compressed core air into the inner passage 130 and its upstream passage segment 134A to mix with the fuel. This fuel-air mixture flows out of the upstream passage segment 134A into the downstream passage segment 134B. The downstream air swirler 118 directs additional compressed core air into the inner passage 130 and its downstream passage segment 134B to further mix with the fuel-air mixture from the upstream passage segment 134A. An ignitor (not shown) may ignite the fuel-air mixture within the downstream passage segment 134B; e.g., the mixer internal volume 70 of the combustion zone 60. The quench apertures 158 direct additional compressed core air into the inner passage 130 and its downstream passage segment 134B to quench (e.g., stoichiometrically lean) the combustion products (e.g., the ignited fuel-air mixture) generated by the ignition of the fuel-air mixture. These quenched combustion products then flow out of the passage outlet orifice 132 into the combustion chamber 68 for further combustion. Thus, the combustion process may initiate within the inner passage 130 of the fuel-air mixer 66 and continue (e.g., substantially finish) within the combustion chamber 68 before flowing into the turbine section 31 and its HPT section 31A through the stator vane array 78.

With the arrangement of FIG. 2, a Rich-Quench-Lean (RQL) combustion process may be shifted upstream into the fuel-air mixer 66. This may facilitate more targeted/tailored quenching of the combustion products, which may be particularly useful with use of alternative fuels such as, but not limited to, hydrogen ($H_2$) gas. By shifting the RQL combustion process further upstream into the fuel-air mixer 66, a time the combustion products are at high temperature may be reduced, which may reduce nitric oxide (NOx) production. Furthermore, by shifting the RQL combustion process further upstream into the fuel-air mixer 66, an overall length of the combustor 64 and its combustion chamber 68 may be reduced. The combustor 64 of FIG. 2, for example, has an axial length that equal to or less than an axial length of the fuel-air mixers 66. Of course, in other embodiments, the combustor length may alternatively be greater than the mixer length. In still other embodiments, the mixer length may be increased such that all of the combustion process occurs within the fuel-air mixers 66 and the combustor 64 may be omitted.

To accommodate the exposure of the fuel-air mixers 66 to the combustion process, each fuel-air mixer 66 receives the steam from the steam source 102. At each fuel-air mixer 66, the steam is directed through each steam passage 146 to cool the mixer sidewall 112. The steam may then be exhausted into the inner passage 130 and/or the combustion chamber 68 to reduce flame temperature. Reducing the flame temperature may in turn reduce nitric oxide (NOx) production. Furthermore, by utilize the steam to cool the fuel-air mixer 66, an entire pressure drop across the mixer sidewall 112 may be used for the quenching of the combustion products. Steam also has a higher heat transfer coefficient than air and, thus, the steam may more efficiently cool the fuel-air mixer 66 than air.

The fuel source 100 of FIG. 2 includes a fuel reservoir 192 and/or a fuel flow regulator 194; e.g., a valve and/or a pump. The fuel reservoir 192 is configured to store the fuel before, during and/or after turbine engine operation. The fuel reservoir 192, for example, may be configured as or otherwise include a tank, a cylinder, a pressure vessel, a bladder or any other type of fuel storage container. The fuel flow regulator 194 is configured to direct and/or meter a flow of the fuel from the fuel reservoir 192 to one or more or all of the fuel-air mixers 66.

The fuel delivered by the fuel source 100 may be a non-hydrocarbon fuel; e.g., a hydrocarbon free fuel. Examples of the non-hydrocarbon fuel include, but are not limited to, hydrogen fuel (e.g., hydrogen ($H_2$) gas) and ammonia fuel (e.g., ammonia ($NH_3$) gas). The turbine engine 20 of FIG. 1 may thereby be configured as a non-hydrocarbon turbine engine; e.g., a hydrocarbon free turbine engine. The present disclosure, however, is not limited to non-hydrocarbon turbine engines. The fuel delivered by the fuel source 100, for example, may alternatively be a hydrocarbon fuel such as, but not limited to, kerosene or jet fuel. The turbine engine 20 of FIG. 1 may thereby be configured as a hydrocarbon turbine engine. Alternatively, the fuel source 100 may be configured as a multi-fuel system operable to deliver, individually or in combination, multiple different fuels (e.g., a non-hydrocarbon fuel and a hydrocarbon fuel, etc.) for combustion within the combustion zone 60. The turbine engine 20 of FIG. 1 may thereby be configured as a multi-fuel turbine engine; e.g., a dual-fuel turbine engine. However, for ease of description, the fuel delivered by the fuel source 100 may be described as the non-hydrocarbon fuel; e.g., the hydrogen fuel.

The steam source 102 may be configured as or otherwise include an evaporator 196, which may be or otherwise include a fluid-to-fluid heat exchanger and/or an electrical heater. The evaporator 196 is configured to evaporate water into the steam during the turbine engine operation. The water may be received from various sources. The steam source 102 of FIG. 2, for example, includes a water reservoir 198 fluidly coupled with and upstream of the evaporator 196. This water reservoir 198 is configured to store the water before, during and/or after turbine engine operation. Examples of the water reservoir 198 include, but are not limited to, a tank, a cylinder, a pressure vessel, a bladder or any other type of water storage container. Briefly, the water may be supplied to the water reservoir 198 by recovering water vapor from the combustion products flowing through the core flowpath 52 (see FIG. 1) and/or from another water source onboard or offboard an aircraft.

While the fuel-air mixers 66 are described above as facilitating combustion/ignition of the fuel-air mixture within the inner passages 130, it is contemplated this combustion/ignition of the fuel air mixture may alternatively be perform downstream of the fuel-air mixers 66. Furthermore, it is contemplated the steam passages 146 may be included in various other fuel-air mixer designs to cool those mixers.

The fuel-air mixer 66 may be included in various turbine engines other than the one described above. The fuel-air mixer 66, for example, may be included in a geared turbine engine where a geartrain connects one or more shafts to one or more rotors in a fan section, a compressor section and/or any other engine section. Alternatively, the fuel-air mixer 66 may be included in a turbine engine configured without a geartrain; e.g., a direct drive turbine engine. The fuel-air mixer 66 may be included in a geared or non-geared turbine engine configured with a single spool, with two spools (e.g., see FIG. 1), or with more than two spools. The turbine engine may be configured as a turbofan engine, a turbojet engine, a turboprop engine, a turboshaft engine, a propfan engine, a pusher fan engine or any other type of turbine engine. The turbine engine may alternatively be configured as an auxiliary power unit (APU) or an industrial gas turbine engine. The present disclosure therefore is not limited to any particular types or configurations of turbine engines.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. An operating method for a turbine engine, comprising:

injecting fuel into an inner passage of a fuel-air mixer;

directing swirled air into the inner passage to mix with the fuel within the inner passage;

cooling a sidewall forming and circumscribing the inner passage, the cooling comprising flowing steam through a steam passage embedded radially within the sidewall;

igniting a mixture of the fuel and the swirled air within the inner passage to form combustion products; and directing quench air through apertures in the sidewall to quench the combustion products within the inner passage.

2. An apparatus for a turbine engine, comprising:

a fuel-air mixer including an inner passage, a sidewall, a steam passage, a fuel nozzle and an air swirler;

the inner passage extending axially along an axis within the fuel-air mixer;

the sidewall extending circumferentially around and axially along the inner passage;

the steam passage embedded within the sidewall and extending along the inner passage;

the fuel nozzle configured to direct fuel into the inner passage; and a plurality of steam outlets arranged through the sidewall in an array about the axis, the plurality of steam outlets fluidly coupled with and downstream of the steam passage;

the air swirler configured to direct swirled air into the inner passage for mixing with the fuel, and the air swirler extending radially across the steam passage to the inner passage.

3. The apparatus of claim 2, wherein the steam passage extends at least one of circumferentially about the inner passage within the sidewall; or axially along the inner passage within the sidewall.

4. The apparatus of claim 2, wherein the fuel-air mixer extends axially along the axis to a mixer end and the plurality of steam outlets are arranged at the mixer end.

5. The apparatus of claim 4, wherein a first of the plurality of steam outlets is configured to exhaust steam received from the steam passage in a radial inward direction towards the axis.

6. The apparatus of claim 4, wherein a first of the plurality of steam outlets is configured to exhaust steam received from the steam passage in an axial direction along the axis.

7. The apparatus of claim 3, wherein a first of the plurality of steam outlets is configured to exhaust steam received from the steam passage into the inner passage.

8. The apparatus of claim 3, wherein a first of the plurality of steam outlets is configured to exhaust steam received from the steam passage out of the fuel-air mixer.

9. The apparatus of claim 2, wherein the fuel-air mixer further includes a second air swirler configured to direct additional swirled air into the inner passage;

the fuel-air mixer extends axially along the axis to a mixer end; and the inner passage radially tapers towards the axis as the inner passage extends axially along the axis away from the second air swirler and towards the mixer end.

10. The apparatus of claim 2, wherein the fuel-air mixer extends axially along the axis to a mixer end; and the inner passage radially expands away from the axis as the inner passage extends axially along the axis away from the air swirler and towards the mixer end.

11. The apparatus of claim 2, wherein the air swirler is configured as a radial air swirler.

12. The apparatus of claim 2, wherein the fuel-air mixer further includes an axial air swirler configured to direct additional swirled air into the inner passage.

13. The apparatus of claim 2, wherein the fuel-air mixer further includes a second air swirler configured to direct additional swirled air into the inner passage;

the fuel-air mixer extends axially along the axis between an upstream mixer end and a downstream mixer end; and the second air swirler is arranged at the upstream mixer end.

14. The apparatus of claim 2, wherein the fuel-air mixer extends axially along the axis between an upstream mixer end and a downstream mixer end; and the air swirler is arranged axially between the fuel nozzle and the downstream mixer end.

15. The apparatus of claim 2, wherein the fuel-air mixer further includes a second air swirler configured to direct additional swirled air into the inner passage;

the fuel-air mixer extends axially along the axis between an upstream mixer end and a downstream mixer end; and the fuel nozzle is arranged axially between the second air swirler and the downstream mixer end.

16. The apparatus of claim 2, wherein the fuel nozzle includes a plurality of fuel outlets arranged in an array about the axis; and a first of the plurality of fuel outlets is configured to inject the fuel in a radial inward direction into the inner passage towards the axis.

17. The apparatus of claim 2, wherein the fuel-air mixer further includes a plurality of quench apertures arranged in an array about the axis;

each of the plurality of quench apertures extends radially through the sidewall to the inner passage; and the plurality of quench apertures are arranged axially between the fuel nozzle and a downstream end of the fuel-air mixer.

18. An apparatus for a turbine engine, comprising:

a tubular body extending circumferentially around an axis, the tubular body extending axially along the axis to a downstream body end, the tubular body extending radially between an inner side and an outer side, the inner side forming an outer peripheral boundary of an inner passage within the tubular body, the inner passage extending axially within the tubular body to an outlet orifice at the downstream body end, a steam passage embedded within the tubular body between the inner side and the outer side, and the steam passage configured to flow steam within the tubular body to cool the tubular body along the inner passage;

a fuel nozzle configured to direct fuel into the inner passage;

a first air swirler, the first air swirler extending radially across the steam passage to the inner passage; and a second air swirler comprising an annular swirler passage, the second air swirler configured to direct swirled air out of the annular swirler passage through an annular outlet from the annular swirler passage into the inner passage for mixing with the fuel within the inner passage, the second air swirler integrated with the tubular body, an upstream portion of the annular swirler passage projecting radially inward towards the axis from an annular inlet into the annular swirler passage, and a downstream portion of the annular swirler passage projecting axially along the axis away from the upstream portion of the annular swirler passage to the annular outlet from the annular swirler passage.

19. The apparatus of claim 18, wherein the fuel nozzle is integrated with the tubular body.

* * * * *